United States Patent [19]

Macy et al.

[11] 4,042,991

[45] Aug. 23, 1977

[54] PARALLELOGRAM STRUCTURE

[75] Inventors: Robert L. Macy; Joseph E. Zupanick, both of Richardson, Tex.

[73] Assignee: Suntech, Inc., St. Davids, Pa.

[21] Appl. No.: 698,443

[22] Filed: June 21, 1976

[51] Int. Cl.[2] ..... E01D 15/2

[52] U.S. Cl. ..... 14/1; 14/17; 14/73; 52/645; 404/35; 182/159

[58] Field of Search ..... 14/69.5, 1, 17, 2.4, 14/73; 52/64, 645; 182/159, 160; 404/35

[56] References Cited

U.S. PATENT DOCUMENTS

| | | | |
|---|---|---|---|
| 400,778 | 4/1889 | Lowe | 182/160 |
| 1,252,873 | 1/1918 | Adams | 14/17 |
| 2,192,269 | 3/1940 | Maddock | 14/17 X |
| 2,344,772 | 3/1944 | Heidenreich | 14/1 |
| 2,744,590 | 5/1956 | Butts | 52/645 |
| 3,138,812 | 6/1964 | Prosser | 14/71.3 |
| 3,722,622 | 3/1973 | Lauring | 182/159 |

*Primary Examiner*—Nile C. Byers, Jr.
*Attorney, Agent, or Firm*—J. Edward Hess; Donald R. Johnson

[57] ABSTRACT

A portable structure which consists of a plurality of I beams placed side by side and hinged together in a parallelogram fashion such that adjacent I beams may be folded together.

5 Claims, 7 Drawing Figures

PARALLELOGRAM STRUCTURE

BACKGROUND OF THE INVENTION

The present invention relates generally to a foldable, portable load-carrying structure, and more particularly to such a structure which may, for example, be used as a portable bridge over leads in Arctic ice regions.

In the Arctic, the ice surface is frequently used to drive, walk and work on. A major problem is that changing conditions such as wind and thermal expansion often cause the ice to break apart, causing leads that are like rivers of open water. these leads may be up to twenty feet wide, and they create a problem when they open up along a route used to transport supplies. It would be desirable to have a system for crossing these leads which would: not take more than eight hours to deploy or retrieve; accomodate the most likely lead of from 5 to 8 foot in width and the largest likely lead of from sixteen to twenty foot in width; be transportable in an aircraft; be buoyant; accomodate fifty thousand pound loads; accomodate loads up to twelve foot wide; accomodate maximum wheel widths of eleven and one half foot; and be able to survive rough treatment and extreme temperatures down to minus sixty degrees Fahrenheit.

SUMMARY OF THE INVENTION

In accordance with a preferred embodiment, a structure is disclosed which folds together for shipment and unfolds for use on location. The structure includes a plurality of I beams placed side by side. Each I beam is coupled to adjacent I beams such that upon folding of the structure, alternate I beams move forward and up relative to the remaining I beams thereby allowing adjacent I beams to fold into each other as much as possible. Further, in the preferred embodiment adjacent I beams are coupled to each other by hinges which have their hinge axes skewed relative to a vertical to cause the upward and forward movement of alternate I beams. Also, in the preferred embodiment the I beams are constructed of aluminum which increases in strength as the temperature drops. Further, in the preferred embodiment a buoyant material is attached to the center vertical members of the I beams to make the structure buoyant in the event it is accidently dropped into the water.

DESCRIPTION OF A PREFERRED EMBODIMENT

Figure 1:
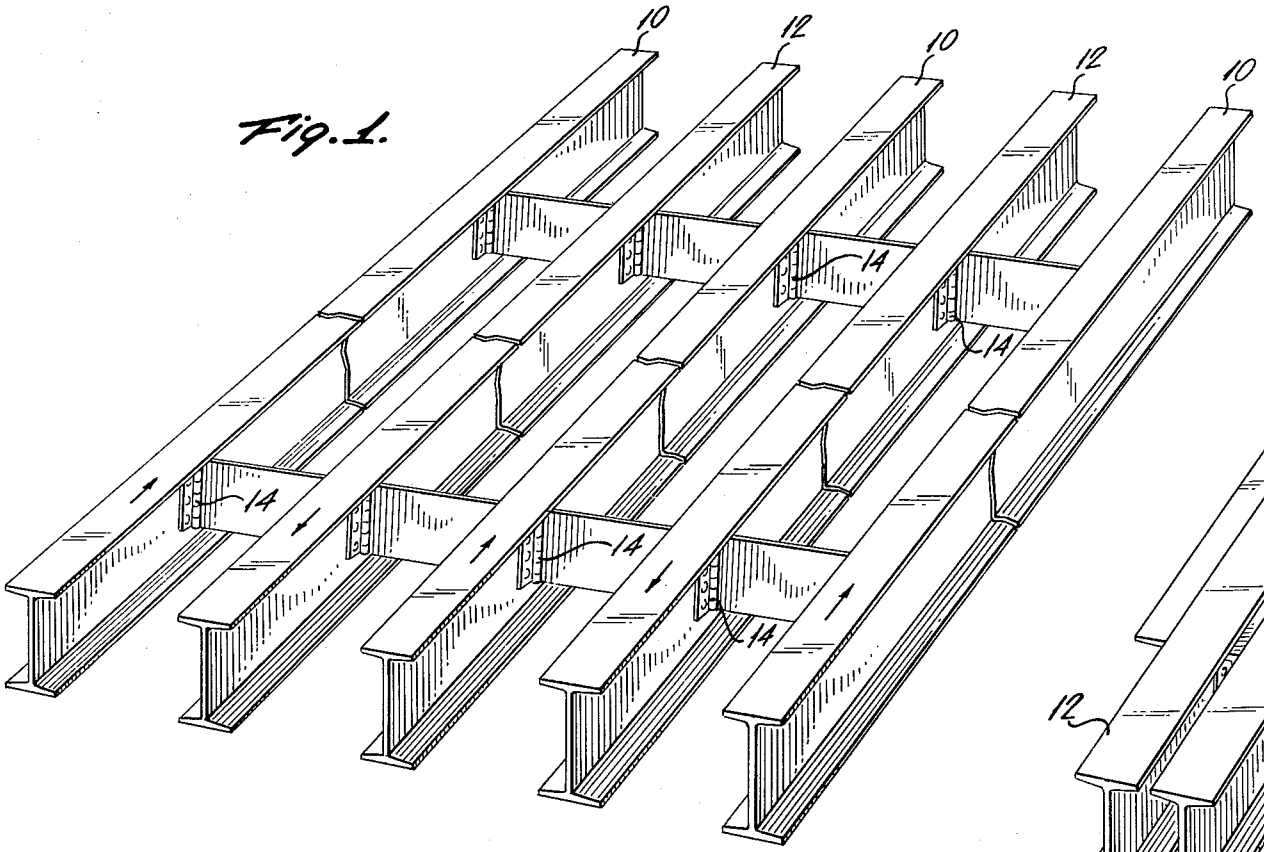

Referring to FIG. 1, there is illustrated a foldable, load-carrying structure in its unfolded position. The structure includes a plurality of I beams which, for purposes of this description, may be referred to as first alternate I beams 10 and second alternate I beams 12. As shown, in the unfolded position the tops of the I beams 10 & 12 lie in the same plane such that the structure may be used as a bridge or other load carrying structure. Each I beam is fastened to each adjacent I beam by hinges 14. As shown clearest in FIG. 3, each hinge 14 pivots about a hinge axis 15 at each end where it is attached to an adjacent I beam. The structure is designed to be folded, as illustrated in FIG. 2, by allowing a forward and upward movement of the second alternate I beams 12 relative to the first alternate I beams 10.

The forward and upward movement of the I beams 12 is caused by a slanting of the hinge axes 15 relative to a vertical 16 (when the structure is in a horizontal position). As shown best in FIG. 3, the hinge axes 15 are inclined rearwardly slightly with respect to a vertical 16. This slight rearward inclination causes a forward and upward movement of the I beams 12 relative to the I beams 10 when the structure is folded.

Figure 2:
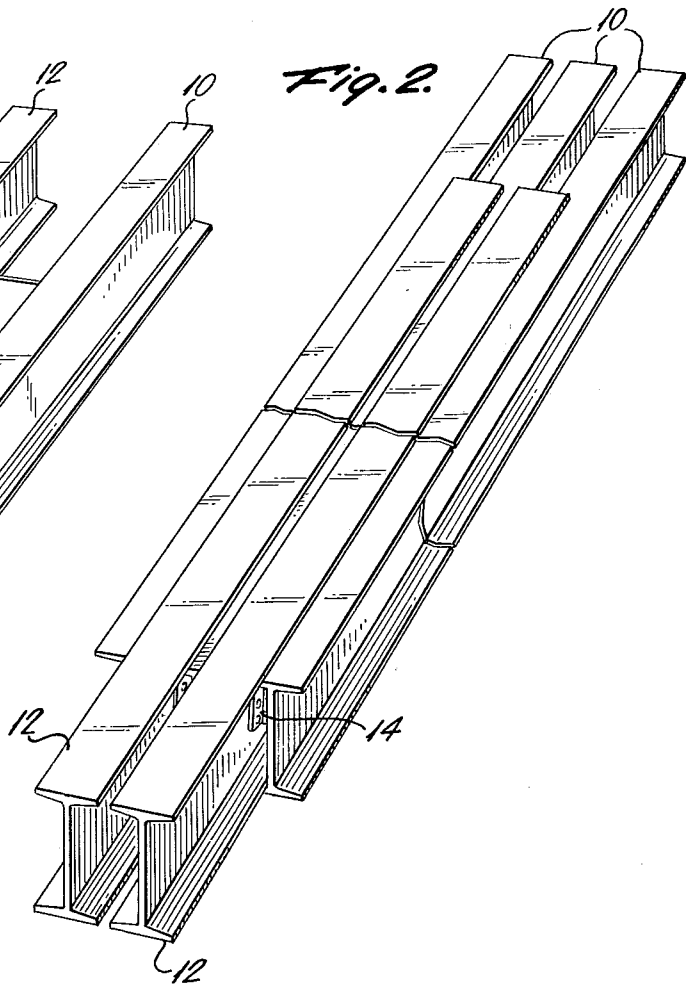
FIGS. 1 and 2 are views respectively of one embodiment of the structure in its unfolded and folded positions.

FIG. 2 illustrates the structure of FIG. 1 in a folded configuration. As may be seen, the I beam 12 have been pivoted forward and upward relative to the I beams 10 such that the top and bottom horizontal members, or flanges, of I beams 12 are raised above the top and bottom horizontal members or flanges, of I beams 10. The limiting factor in folding the structure is the contact of top and bottom horizontal members with adjacent vertical members.

Figure 3:
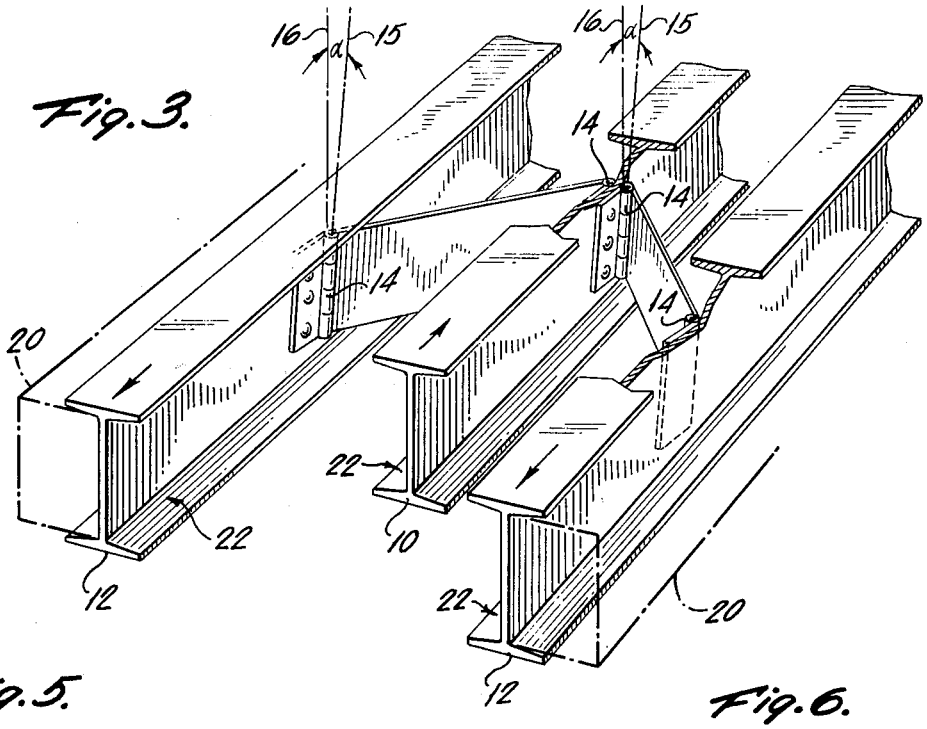
FIG. 3 is a partially cut-away, detailed view of the hinging arrangement which allows folding of the structure.

FIG. 3 illustrates another aspect of the present invention. Since the structure has application as a bridge it would be desirable for it to be buoyant in the event it is accidently dropped into the water. This way be accomplished by affixing a buoyant material, such as closed cell rigid foam, to areas of the structure where do not interfere with its folding. For instance, foam may be attached along the outside of each of the two side peripheral I beams, as shown at 20, and also in interior areas 22 which do not interfere with folding of the structure.

One designed embodiment of the present invention resulted in a structure weighing approximately 4500 pounds, having a deployed length and width of 30 and 12 feet, and having a load-carrying capacity of 50,000 pounds.

Figure 4:
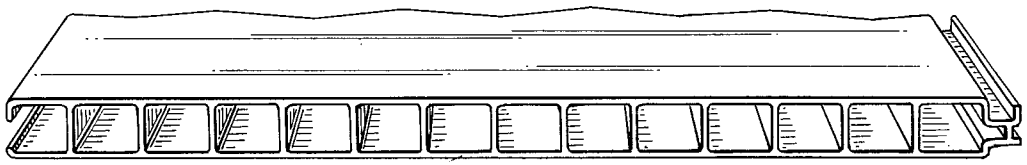
FIG. 4 is a side view of planking which may be utilized with the present invention when it is used as a bridge.

One variable in designing embodiments of the present invention is the deployed spacing between the I beams, which is determined by the hinge lengths. If the bridge is designed to open with substantial gaps between adjacent beams, then it may be desirable to utilize planking placed crosswise across the top of the I beams. This planking may simply be ordinary wood planking, or in one embodiment may be aluminum landing planking, a side view of which is shown in FIG. 4. This planking is available from the Metal Products Department of the Dow Chemical Company, Midland, Michigan.

Figure 5:
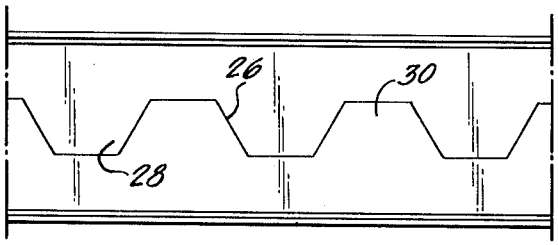
FIGS. 5 & 6 show one type of I beam which may have particular utility with the present invention.
Figure 6:
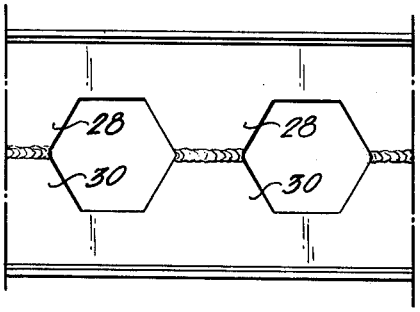

FIGS. 5 and 6 show a particular type of I beam which should be useful with the present invention. This type of I beam is constructed from a typical I beam as follows. Referring to FIG. 5, the I beam is first cut along a line 26, then the top half is shifted sideways relative to the bottom half such that the portion of the top half at 28 now abutts the portion of the bottom half at 30, resulting in a beam as shown in FIG. 6. The beam is then welded at the adjoining portions. This results in a beam having an increased height, and provides a stronger beam for the same amount of structural material. The hinges of the present invention provide substantial lateral stability to the I bems such that an I beam as illustrated in FIG. 6 should find utility with the teachings of the present invention.

Figure 7:
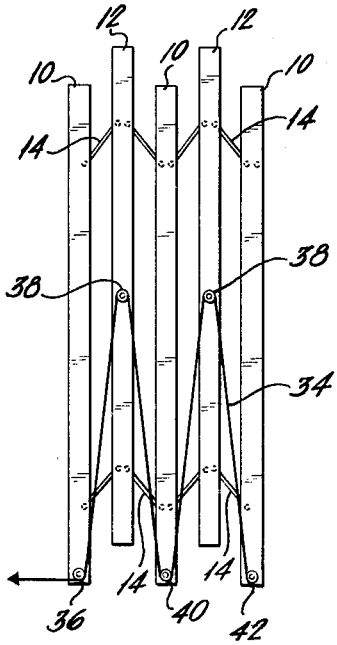
FIG. 7 illustrates one embodiment of the present invention which utilizes a cable system for deployment.

FIG. 7 illustrates one manner in which a parallelogram structure may be unfolded or deployed. FIG. 7 is a schematic presentation, and illustrates a top view of I beams 10 and 12 and connected by hinges 14. A cable 34 extends from one end of the first I beam 10 to a point along the length of a second I beam 12 (near the middle in the illustrated embodiment) wherein a pulley 38 is secured to the center structural member of the I beam 12 and then back to the end of the second I beam 10 wherein a further pulley 40 is positioned, and then back again to a point along the length of the second I beam 12 to another pulley 38, and then back to a point of attachment 42 at the end of the third I beam 10. A structure constructed in this fashion would be unfolded or deployed by shortening the cable, as by a winch at one end of the cable. This would result in pulling the I beams 12 down, as shown in FIG. 7, toward the I beams 10 until the structure is fully opened and deployed. The hinges may have mechanical stops such that when they unfold to a 90° position relative to the I beams, they will be prevented from pivoting further. This would result in a rigid structure which is maintained stable by the hinge mechanical stops and the taut cable.

Although at least one embodiment of the present invention has been described, the teachings of this invention will suggest many other embodiments to those skilled in the art.

The invention claimed is:

1. A portable structure which may be folded together for transporation or storage and then unfolded for use, and comprising:

a. a plurality of I beams positioned side by side and having a first plurality of alternate I beams and a second plurality of alternate I beams, with each second alternate I beam being positioned adjacent to first alternate I beams; and a. inclined pivot means for securing said plurality of I beams together such that the I beams may be folded together by having said first plurality of alternate I beams move relative to said second plurality of alternate I beams causing the top and bottom flanges of said first plurality of alternate I beams to rise over the top and bottom flanges of said adjacent plurality of second alternate I beams, and the same may be unfolded to form a structure wherein the tops of all of the plurality of I beams lie in the same plane, whereby the structure may be used as a load carrying structure.

2. A portable structure as set forth in claim 1 wherein said securing means includes a plurality of hinges coupling adjacent I beams with each of said plurality of hinges having its axes about which it hinges skewed relative to a vertical when the structure is in a horizontal position.

3. A portable structure as set forth in claim 2 wherein each said I beam comprises an aluminum I beam.

4. A structure as set forth in claim 2 designed to be used as a bridge and wherein a buoyant material is affixed to at least one I beam to make the bridge buoyant.

5. A structure as set forth in claim 2 and wherein a cable extends from first ends of said first alternate I beams to some point along the lengths of said second alternate I beams in a fashion to allow the structure to be deployed by tensioning the cable.

* * * * *